United States Patent [19]

Wulc

[11] 4,430,815

[45] Feb. 14, 1984

[54] FABRIC TENSION APPARATUS FOR SCREEN PRINTING FRAME

[75] Inventor: Stanley S. Wulc, Rydal, Pa.

[73] Assignee: Stretch Devices, Inc., Philadelphia, Pa.

[21] Appl. No.: 317,374

[22] Filed: Nov. 2, 1981

[51] Int. Cl.[3] ..... D06C 3/08

[52] U.S. Cl. ..... 38/102.91; 101/127.1; 160/395

[58] Field of Search ..... 38/102.1, 102.91; 101/127.1, 128, 128.1; 160/395, 378, 329

[56] References Cited

U.S. PATENT DOCUMENTS

| | | | |
|---|---|---|---|
| 142,232 | 8/1873 | Holly | 160/378 |
| 1,138,986 | 5/1915 | Sisbower et al. | 160/329 |
| 1,895,309 | 1/1933 | Boomershine | 160/378 |
| 3,783,931 | 1/1974 | Assael | 160/395 X |
| 3,908,293 | 9/1975 | Newman | 38/102.91 |
| 4,057,095 | 11/1977 | Hinota | 160/395 X |
| 4,345,390 | 8/1982 | Newman | 38/102.91 |

FOREIGN PATENT DOCUMENTS

| | | | |
|---|---|---|---|
| 122170 | 7/1948 | Sweden | 38/102.1 |

*Primary Examiner*—Werner H. Schroeder
*Assistant Examiner*—Andrew M. Falik
*Attorney, Agent, or Firm*—Seidel, Gonda & Goldhammer

[57] ABSTRACT

The edge portions of a screen fabric are attached to a screen printing frame. The frame has discrete springs in contact with the fabric adjacent the location of securement of the fabric to the frame. The springs provide for a limited amount of movement of the fabric toward a substrate by deformation of the springs instead of relying only on stretching the fabric.

7 Claims, 7 Drawing Figures

FIG. 1
PRIOR ART
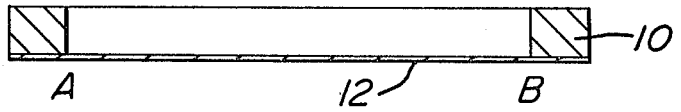
FIG. 2
PRIOR ART
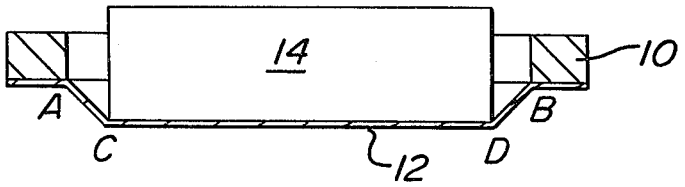
FIG. 3
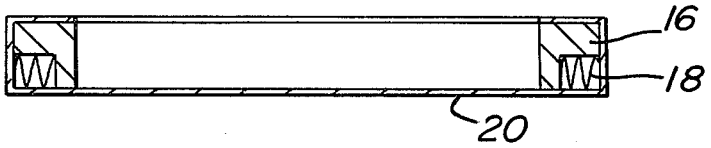
FIG. 4
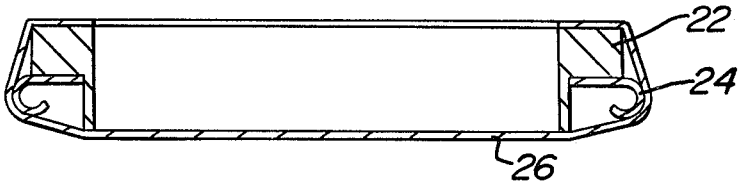
FIG. 5
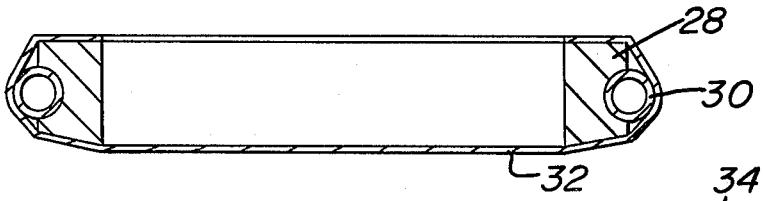
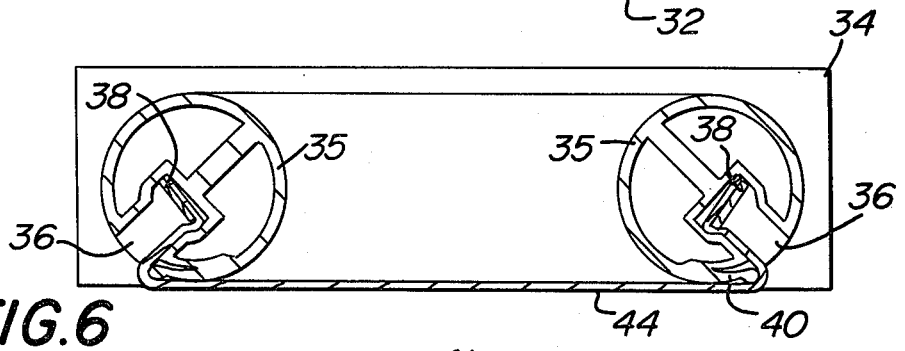
FIG. 6
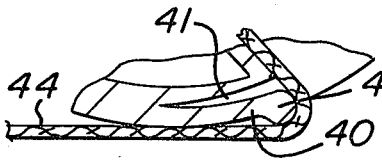
FIG. 7

FABRIC TENSION APPARATUS FOR SCREEN PRINTING FRAME

BACKGROUND

Screen printing frames are known. For example, see U.S. Pat. No. 3,908,293. In said patent there is disclosed screen tensioning rollers which are rotatable relative to a frame for tensioning an edge portion of a fabric.

In a conventional screen printer, fabric is stretched so as to be in high tension in order to retain the stability of the stencil and provide for the snappy return from the printed surface to its original position. With constant off contact printing and with wider image area and a wider squeegee approaching the inner periphery of the frame, the required elongation of the fabric becomes greater. This results in distortion of the stencil, excessive pressure of squeegee on the fabric, inability to print accurately with maximum utilization of the fabric area, and a shorter life for the fabric and squeegee.

The present invention is directed to a solution of this problem.

SUMMARY OF THE INVENTION

The invention is directed to a screen printing apparatus which includes a frame to which will be attached to the edge portions of a screen fabric. The frame has spring means thereon for contact with the fabric adjacent the location of securement of the fabric to the frame. In off contact printing the spring means provides for a limited amount of movement of the fabric toward a substrate by deformation of the spring means instead of relying only on stretching the fabric.

It is an object of the present invention to provide screen printing apparatus which provides for better utilization of the printing area, lower image distortion, lower squeegee pressures, and consequently longer life for the squeegee and fabric.

It is another object of the present invention to provide screen printing apparatus which reduces stretching of the fabric in a manner which is simple, inexpensive, and reliable.

Other objects and advantages will appear hereinafter.

For the purpose of illustrating the invention, there is shown in the drawing a form which is presently preferred; it being understood, however, that this invention is not limited to the precise arrangements and instrumentalities shown.

FIG. 1 is a diagramatic cross-sectional view of a conventional screen printing frame.

FIG. 2 is a view similar to FIG. 1 but showing the fabric stretched by the squeegee.

FIG. 3 is a cross-sectional view through an off-contact screen printing frame in accordance with a first embodiment of the present invention.

FIG. 4 is a cross-sectional view of a screen printing frame in accordance with a second embodiment of the present invention.

FIG. 5 is a cross-sectional view of a screen printing frame in accordance with a third embodiment of the present invention.

FIG. 6 is a cross-sectional view of a screen printing frame in accordance with a fourth embodiment of the present invention.

FIG. 7 is an enlarged detailed view of the spring in FIG. 6.

DETAILED DESCRIPTION OF PRIOR ART

Referring to FIG. 1, there is shown a sectional view through a rectangular screen printing frame designated generally as 10 and having a screen printing fabric 12 attached thereto. When a squeegee 14 is applied to the fabric 12 as shown in FIG. 2, the fabric is stretched so as to lie along the line ACDB. By comparing FIGS. 1 and 2, it will be noted that the line ACDB is longer than the line AB. When the elongation is substantial, there is distortion of the stencil, excess pressure on the fabric, and the inability to print accurately with maximum utilization of the fabric area thereby shortening the life of the fabric 12 and squeegee 14.

DETAILED DESCRIPTION OF THE INVENTION

Referring to FIG. 3, there is illustrated a first embodiment of the invention with a rectangular frame 16 shown in section. The outer periphery of the frame 16 is notched so as to provide a space for receiving a spring means 18. Spring means 18 may be a discrete accordian spring extending along the length of each side of the frame 16. The innermost end of each spring means is secured to its associated side of the frame by a fastener, clips, etc.

The fabric 20 is attached to the frame in any conventional manner and is in contact with the spring means 18. When a squeegee 14 is applied to the fabric 20, spring means 18 will deform inwardly thereby providing for movement of the fabric without excessively stretching the fabric. Thus, the additional tension induced by the squeegee 14 is readily absorbed by the spring means 18 thereby reducing the physical elongation of the fabric 20. The spring rate of the spring means 18 is lower than that of the fabric 20.

The embodiment of the invention as shown in FIG. 3 permits better utilization of the printing area since the excessive elongation requirements imposed on the fabric 20 in printing close to the edge of the frame 16 are absorbed by the spring means 18. This results in lower image distortion, lower squeegee pressures, and consequently longer life of the squeegee and fabric.

In FIG. 4, there is illustrated another embodiment of the present invention wherein the notch on the outer periphery of each side of the frame 22 contains a curved leaf spring 24 secured thereto as described above. Leaf springs 24 cooperates with the fabric 26 in the same manner as described above.

In FIG. 5 there is illustrated another embodiment of the present invention wherein frame 28 has a groove on its outer periphery. In the groove on each side of the frame there is provided a spring 30 in the form of a tube open at its ends. Spring 30 may be a solid elastomer if desired. Springs 30 are secured to the sides of the frame 28 in any convenient manner including use of adhesives. Springs 30 may be made of spring metal, plastic, or other materials. Springs 30 cooperates with the fabric 32 in the same manner as described above.

In FIG. 6 there is shown another embodiment of the present invention wherein the frame 34 rotatably supports four rollers 35. Two of the rollers are parallel to each other and perpendicular to the other rollers. The frame and rollers may be coupled together as disclosed in the above-mentioned patent. The rollers have a channel 36. Each channel 36 contains a retainer 38 for trapping an edge portion of the fabric 44. Adjacent each of the channels 36 there is provided a leaf spring 40.

Each spring 40 is a cantalever attained by providing a slit 41 in the wall thickness of the extruded tube 35. Each spring 40 preferably has a knob 42 at its free in contact with the fabric 44 as shown more clearly in FIG. 7. The knob 42 on each leaf spring 40 causes the forces applied to the leaf springs 40 to be concentrated at the free end of the springs 40. The embodiment shown in FIGS. 6 and 7 cooperates with the fabric 44 in the same manner as described above.

Thus, it was seen that the screen printing frame of the present invention includes a spring means in contact with the fabric so that the fabric may be moved toward and away from a substrate by deformation of the spring means instead of stretching the fabric. The amount of deformation of the springs may be quite small, on the order of 0.001–0.02 inches. A spring printing frame in accordance with the present invention solves the problem described above and provides various advantages as disclosed herein.

The present invention may be embodied in other specific forms with departing from the spirit or essential attributes thereof and, accordingly, reference should be made to the appended claims, rather than to the foregoin specification, as indicating the scope of the invention.

I claim:

1. A screen printing apparatus comprising a screen printing frame attached to the edge portions of a screen fabric, the frame having spring means supported thereon in contact with the fabric to provide for a limited movement of the fabric by deformation of the spring means instead of relying only on stretching of the fabric, said frame supporting a plurality of rollers each having a channel for receiving an edge portion of the fabric, each roller having said spring means adjacent the channel, said spring means being an integral part of the roller.

2. Apparatus in accordance with claim 1 wherein said spring means has a knob on the free end thereof.

3. A screen printing apparatus comprising a rectangular frame having spring means supported on the outer periphery thereof, said spring means having its outer periphery in a location for contact with the inner surface of a screen printing fabric to facilitate moving the fabric during use by deformation of the spring means instead of relying on stretching of the fabric, said fabric having a planar central portion below the frame and having its peripheral edge portions extending upwardly along the outer periphery of the frame, said spring means contacting upwardly extending portions of the fabric.

4. Apparatus in accordance with claim 3 wherein said spring means is a leaf spring.

5. Apparatus in accordance with claim 3 wherein said spring means is a tube.

6. Apparatus in accordance with claim 3 wherein said means includes a pair of oppositely disposed accordion springs.

7. Apparatus in accordance with claim 3 wherein said spring means includes a pair of oppositely disposed hollow resilient tubes.

* * * * *